US010781768B2

(12) United States Patent
Kodama et al.

(10) Patent No.: US 10,781,768 B2
(45) Date of Patent: Sep. 22, 2020

(54) CONTROL DEVICE FOR DIRECT FUEL INJECTION ENGINE AND CONTROL METHOD THEREOF

(71) Applicant: NISSAN MOTOR CO., LTD., Yokohama-shi, Kanagawa (JP)

(72) Inventors: Takayoshi Kodama, Kanagawa (JP); Masaharu Kassai, Kanagawa (JP); Yoshihiko Iwabuchi, Kanagawa (JP)

(73) Assignee: NISSAN MOTOR CO., LTD., Yokohama-shi (JP)

( * ) Notice: Subject to any disclaimer, the term of this patent is extended or adjusted under 35 U.S.C. 154(b) by 0 days.

(21) Appl. No.: 16/621,753

(22) PCT Filed: Jun. 15, 2017

(86) PCT No.: PCT/JP2017/022128
§ 371 (c)(1),
(2) Date: Dec. 12, 2019

(87) PCT Pub. No.: WO2018/229933
PCT Pub. Date: Dec. 20, 2018

(65) Prior Publication Data

US 2020/0208589 A1 Jul. 2, 2020

(51) Int. Cl.
*F02D 41/36* (2006.01)
*F02D 41/14* (2006.01)
(Continued)

(52) U.S. Cl.
CPC ..... *F02D 41/365* (2013.01); *F02D 41/04* (2013.01); *F02D 41/1475* (2013.01); *F02D 41/3029* (2013.01)

(58) Field of Classification Search
CPC ..... F02D 41/3011; F02D 41/3094; F02D 41/3023; F02D 41/3029; F02D 41/3064;
(Continued)

(56) References Cited

U.S. PATENT DOCUMENTS 8,468,823 B2 * 6/2013 Hitomi ..... F02D 41/3035 123/564
2004/0134462 A1 * 7/2004 Strom ..... F02D 41/3064 123/294
(Continued)

FOREIGN PATENT DOCUMENTS

CN 101858267 A 10/2010
CN 103670761 A 3/2014
(Continued)

*Primary Examiner* — George C Jin
(74) *Attorney, Agent, or Firm* — Foley & Lardner LLP

(57) ABSTRACT

A direct fuel injection engine including an ignition plug and a fuel injection valve arranged to be capable of injecting a fuel directly in a cylinder is controlled. The engine has a predetermined operation region in which an excess air ratio of an air-fuel mixture is set in a vicinity of 2. In a first region on a low load side of the predetermined operation region, a homogenous air-fuel mixture having the excess air ratio at a first predetermined value in the vicinity of 2 is formed upon combustion, and in a second region on a load side higher than the first region, a stratified air-fuel mixture having the excess air ratio at a second predetermined value in the vicinity of 2 is formed upon combustion.

9 Claims, 9 Drawing Sheets

(51) Int. Cl.
*F02D 41/04* (2006.01)
*F02D 41/30* (2006.01)

(58) Field of Classification Search
CPC .... F02D 41/365; F02D 41/04; F02D 41/1475; F02D 2041/3052; F02D 2250/21; F02P 5/145
See application file for complete search history.

(56) References Cited

U.S. PATENT DOCUMENTS

| | | | | |
|---|---|---|---|---|
| 2005/0161018 | A1 | 7/2005 | Tomita | |
| 2005/0161020 | A1 | 7/2005 | Tomita | |
| 2005/0161021 | A1 | 7/2005 | Ishii et al. | |
| 2005/0268870 | A1* | 12/2005 | Hotta | F02B 75/048 123/78 F |
| 2009/0229564 | A1* | 9/2009 | Kang | F02B 17/005 123/295 |
| 2011/0067679 | A1 | 3/2011 | Hitomi et al. | |
| 2014/0076280 | A1 | 3/2014 | Kondo et al. | |
| 2020/0173417 | A1* | 6/2020 | Maeda | F02D 37/02 |

FOREIGN PATENT DOCUMENTS

| | | | |
|---|---|---|---|
| JP | 2004-245171 | A | 9/2004 |
| JP | 2005-214041 | A | 8/2005 |
| JP | 2005-344644 | A | 12/2005 |
| JP | 2006-57604 | A | 3/2006 |
| JP | 2006-70863 | A | 3/2006 |
| JP | 2009-293443 | A | 12/2009 |
| JP | 2010-37948 | A | 2/2010 |
| JP | 2010-116876 | A | 5/2010 |

* cited by examiner

CONTROL DEVICE FOR DIRECT FUEL INJECTION ENGINE AND CONTROL METHOD THEREOF

TECHNICAL FIELD

The present invention relates to a direct fuel injection engine operated by a lean air-fuel mixture with an excess air ratio in the vicinity of 2 and a control method thereof.

BACKGROUND ART

A demand for improvement of fuel efficiency of an internal combustion engine has increased for further reduction of an environmental load. Leaning of the air-fuel mixture is an already known measure for improving the fuel efficiency of the internal combustion engine. However, even under combustion by the lean air-fuel mixture, in an operation region where an engine load is high and a fuel supply amount is large, knocking occurs in some cases. As an art for suppressing the knocking, retarding of ignition timing is known.

JP2010-116876 discloses retarding of the ignition timing in order to suppress the knocking in a high load region. Specifically, whether it is in a high load region having a high heat load is determined on the basis of an engine load, a revolution speed and the like, and if it is determined to be in the high load region, the ignition timing is retarded (paragraph 0013).

SUMMARY OF INVENTION

However, when the ignition timing is retarded, heat efficiency is lowered, and the fuel efficiency is deteriorated.

The knocking can be also suppressed by lowering a compression ratio other than retarding of the ignition timing. However, if the compression ratio is lowered, not only that the heat efficiency is lowered, but an ignition performance is deteriorated by lowering of an in-cylinder temperature, which makes combustion unstable. In response to that, the ignition performance can be ensured by lowering the excess air ratio of the air-fuel mixture or an air-fuel ratio and by relatively increasing a fuel amount in the air-fuel mixture, but not only the effect of improvement in the fuel efficiency by leaning of the air-fuel mixture is lessened but also an NOx emission is increased as a result.

The present invention has an object to realize combustion with the excess air ratio of the air-fuel mixture in the vicinity of 2 while high heat efficiency is maintained.

In one aspect of the present invention, a control method for a direct fuel injection engine is provided.

A control method according to this aspect is a method that controls a direct fuel injection engine including an ignition plug and a fuel injection valve arranged to be capable of injecting a fuel directly in a cylinder, and having a predetermined operation region in which an excess air ratio of an air-fuel mixture is set in a vicinity of 2. In a first region on a low load side of the predetermined operation region, a homogenous air-fuel mixture having the excess air ratio at a first predetermined value in the vicinity of 2 is formed to perform combustion, and in a second region on a load side higher than the first region, a stratified air-fuel mixture having the excess air ratio at a second predetermined value in the vicinity of 2 is formed to perform combustion.

In another aspect of the present invention, a control device for a direct fuel injection engine is provided.

DESCRIPTION OF EMBODIMENTS

An embodiment of the present invention will be described below by referring to the attached drawings.

(Entire Configuration of Engine)

Figure 1:
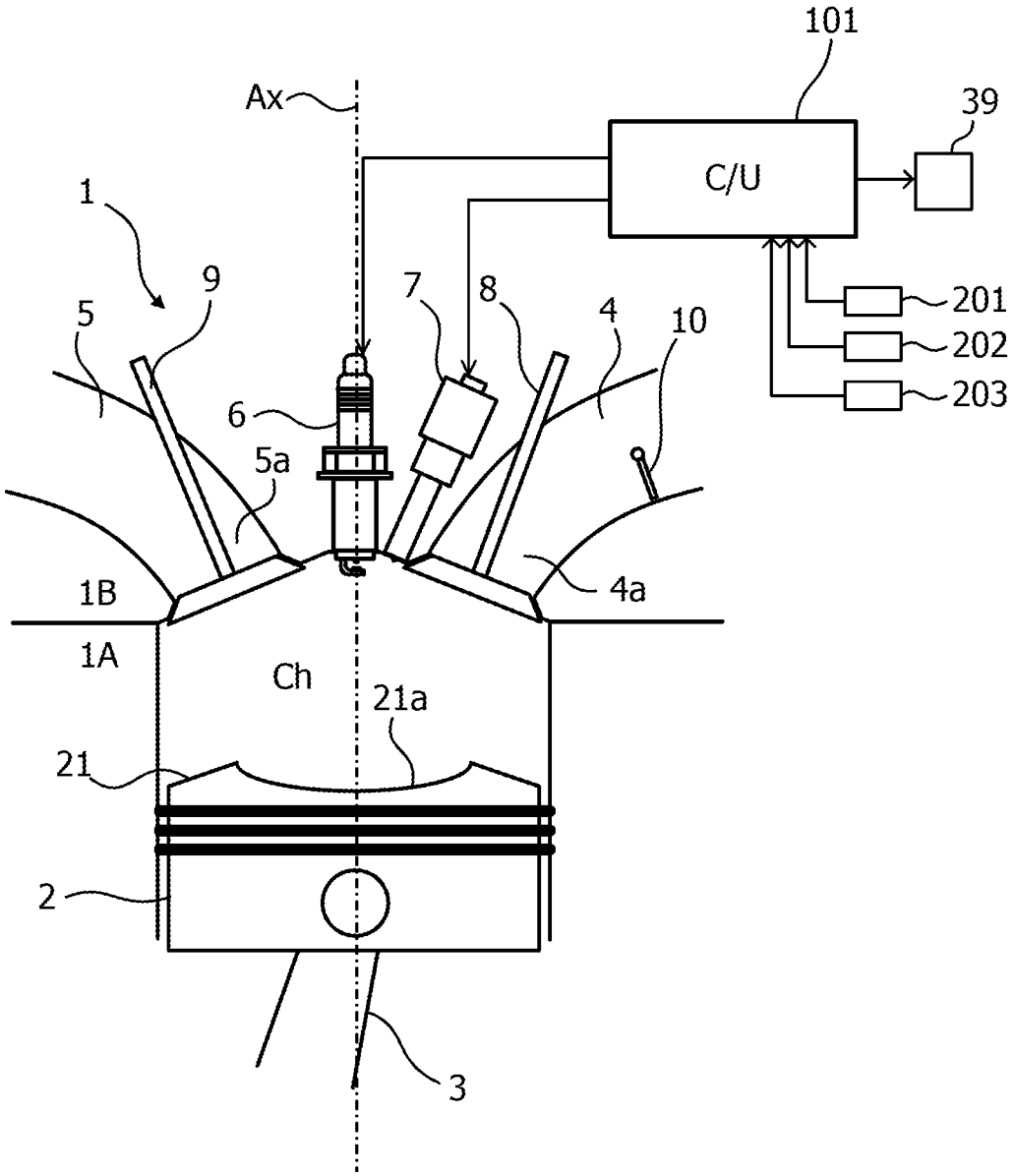
FIG. 1 is a configuration diagram of a direct fuel injection engine according to an embodiment of the present invention.

FIG. 1 is a configuration diagram of a direct fuel injection engine (spark ignition engine and hereinafter, referred to as an "engine") 1 according to an embodiment of the present invention.

The engine 1 has its body formed by a cylinder block 1A and a cylinder head 1B, and a cylinder or an air cylinder is formed as a space surrounded by the cinder block 1A and the cylinder head 1B. FIG. 1 illustrates only one cylinder, but the engine 1 may be a multi-cylinder type direct fuel injection engine having a plurality of cylinders.

A piston 2 is inserted into the cylinder block 1A capable of reciprocating up/down along a cylinder center axis Ax, and the piston 2 is connected to a crank shaft, not shown, through a connecting rod 3. A reciprocating motion of the piston 2 is transmitted to the crank shaft through the connecting rod 3 and is converted to a rotary motion of the crank shaft. A cavity 21*a* is formed in a top surface 21 of the piston 2, and interference of a smooth flow of air sucked into the cylinder through an intake port 4*a* by the piston top surface 21 is suppressed.

A lower surface defining a pent-roof type combustion chamber Ch is formed on the cylinder head 1B. The combustion chamber Ch as a space surrounded by the lower surface of the cylinder head 1B and the piston top surface 21 is formed. A pair of intake passages 4 on one side of the cylinder center axis Ax and a pair of exhaust passages 5 on the other side are formed in the cylinder head 1B as passages allowing the combustion chamber Ch and an outside of the engine to communicate with each other. An intake valve 8 is installed on a port portion (intake port) 4*a* of the intake passage 4, and an exhaust valve 9 is installed on a port portion (exhaust port) 5*a* of the exhaust passage 5. The air taken into the intake passage 4 from the outside of the engine is sucked into the cylinder during an open period of the intake valve 8, and the exhaust gas after combustion is exhausted to the exhaust passage 5 during the open period of the exhaust valve 9. A throttle valve, not shown, is installed in the intake passage 4, and a flowrate of the air taken into the cylinder is controlled by the throttle valve.

An ignition plug 6 is further installed on the cylinder center axis Ax between the intake port 4*a* and the exhaust port 5*a* in the cylinder head 1B, and a fuel injection valve 7 is installed between the pair of intake ports 4*a* and 4*a* on one side of the cylinder center axis Ax. The fuel injection valve 7 is configured capable of direct injection of a fuel into the cylinder upon receipt of supply of the fuel from a high-pressure fuel pump, not shown. The fuel injection valve 7 is a multi-hole type fuel injection valve and is disposed on the intake port 4*a* side of the cylinder center axis Ax so that the fuel is injected to a direction diagonally crossing the cylinder center axis Ax, or in other words, so that a spray beam gravity-center line AF which will be described later and the cylinder center axis Ax cross each other at a sharp angle. In this embodiment, the fuel injection valve 7 is provided at a position surrounded by the ignition plug 6 and the intake ports 4*a* and 4*a*. Not limited to such disposition, the fuel injection valve 7 can be installed on a side opposite to the ignition plug 6 with respect to the intake port 4*a*.

A tumble control valve 10 is installed in the intake passage 4, and an opening area of the intake passage 4 is substantially narrowed by the tumble control valve 10, whereby a flow of the air in the cylinder is reinforced. In this embodiment, a tumble flow in which the air taken into the cylinder through the intake part 4*a* passes to the side opposite to the intake port 4*a* with respect to the cylinder center axis Ax, or in other words, passes to the direction from the lower surface of the cylinder head 1B toward the piston top surface 21 through an in-cylinder space on the exhaust port 5*a* side is formed as the air flow, and this tumble flow is reinforced by the tumble control valve 10. The reinforcement of the in-cylinder flow is not limited to installation of the tumble control valve 10 but can be also achieved by changing a shape of the intake passage 4. For example, the shape may be such that the intake passage 4 is brought into a state closer to upright so that the air flows into the cylinder at a gentler angle to the cylinder center axis Ax or that a center axis of the intake passage 4 is brought into a state closer to a straight line so that the air flows into the cylinder with more energy.

An exhaust purifying device (not shown) is interposed in the exhaust passage 5. In this embodiment, a catalyst having an oxidation function is built in the exhaust purifying device, and the exhaust gas after the combustion exhausted to the exhaust passage 5 has hydrocarbon (HC) purified by oxygen remaining in the exhaust gas and then, emitted into the atmosphere. As will be described later, in this embodiment, the combustion is performed with the excess air ratio λ of the air-fuel mixture in the vicinity of 2 in the entire operation region of the engine 1, but in a region on a lean side where the excess air ratio λ is higher than a stoichiometric air-fuel ratio equivalent value, emissions of carbon monoxide (CO) and nitrogen oxide (NOx) are reduced, while HC tends to maintain a constant emission. By means of the operation in which the excess air ratio λ is increased so as to have the air-fuel ratio largely higher than the stoichiometric value, emission of HC to the atmosphere can be suppressed while emission itself of NOx is kept low.

(Configuration of Variable Compression Ratio Mechanism)

Figure 2:
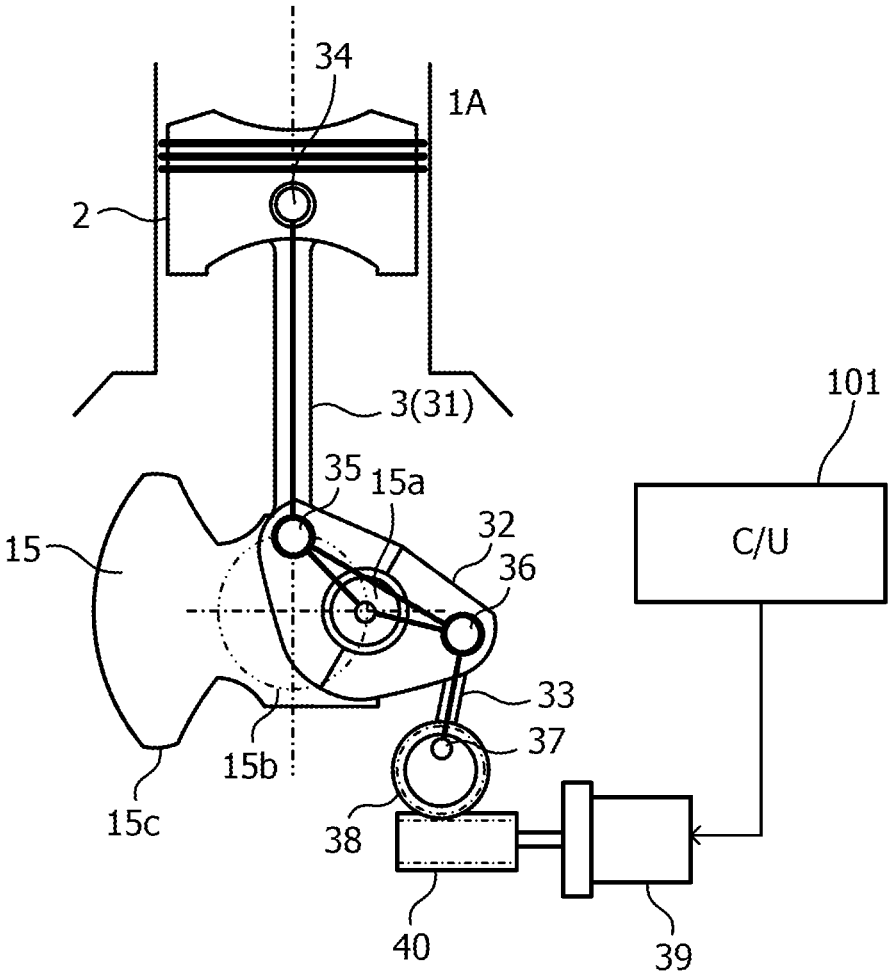
FIG. 2 is a configuration diagram of a variable compression ratio mechanism provided in the engine.

FIG. 2 is a configuration diagram of a variable compression ratio mechanism provided in the engine 1.

In this embodiment, a top dead center position of the piston 2 is changed by the variable compression ratio mechanism, and a compression ratio of the engine 1 is mechanically changed.

The variable compression ratio mechanism changes the compression ratio by connecting the piston 2 and the crank shaft 15 through an upper link 31 (connecting rod 3) and a lower link 32 and by adjusting an attitude of the lower link 32 by a control link 33.

The upper link 31 is connected to the piston 2 by a piston pin 34 on an upper end.

The lower link 32 has a connection hole at a center and is connected to the crank shaft 15 capable of swing around a crank pin 15*a* by inserting the crank pin 15*a* of the crank shaft 15 into this connection hole. The lower link 32 is connected to a lower end of the upper link 31 by a connection pin 35 on one end and is connected to an upper end of the control link 33 by a connection pin 36 on the other end.

The crank shaft 15 includes the crank pin 15*a*, a crank journal 15*b*, and a balance weight 15*c* and is supported by the crank journal 15*b* with respect to the engine body. The crank pin 15*a* is provided at a position biased to the crank journal 15*b*.

The control link 33 is connected to the lower link 32 by a connection pin 36 on the upper end and is connected to the control shaft 38 by a connection pin 37 on the lower end. The control shaft 38 is disposed in parallel with the crank shaft 15, and the connection pin 37 is provided at a position biased from the center. The control shaft 38 has a gear formed on an outer periphery. The gear of the control shaft 38 is engaged with a pinion 40 driven by an actuator 39, and by rotating the pinion 40 by the actuator 39, the control shaft 38 is rotated, and an attitude of the lower link 32 can be changed through movement of the connection pin 37.

Specifically, by rotating the control shaft 38 so that the position of the connection pin 37 is relatively lower than the center of the control shaft 38, the attitude or inclination of the lower link 32 can be changed so that the position of the connection pin 35 is relatively higher than the center of the crank pin 15*a* (the lower link 32 is rotated clockwise in a state illustrated in FIG. 2), and the compression ratio of the engine 1 can be mechanically increased. On the other hand, by rotating the control shaft 38 so that the position of the connection pin 37 is relatively higher than the center of the control shaft 38, the attitude or inclination of the lower link 32 can be changed so that the position of the connection pin 35 is relatively lower than the center of the crank pin 15*a* (the lower link 32 is rotated counterclockwise in the state illustrated in FIG. 2), and the compression ratio of the engine 1 can be mechanically lowered.

In this embodiment, the compression ratio is lowered with respect to the increase in the engine load by the variable compression ratio mechanism.

(Configuration of Control System)

The operation of the engine 1 is controlled by an engine controller 101.

In this embodiment, the engine controller 101 is configured as an electronic control unit and made of a microcomputer including a central processing unit, various storage devices such as ROM and RAM, an input/output interface and the like.

Detection signals of an accelerator sensor 201, a revolution speed sensor 202, and a cooling water temperature sensor 203 are input into the engine controller 101, and detection signals of an airflow meter, an air-fuel ratio sensor and the like, not shown, are also input.

The accelerator sensor 201 outputs a signal according to an operation amount of an accelerator pedal by an operator. The operation amount of the accelerator pedal is an index of a load requested toward the engine 1.

The revolution speed sensor 202 outputs a signal according to a revolution speed of the engine 1. A crank angle sensor can be employed as the revolution speed sensor 202, and the revolution speed can be detected by converting a unit crank angle signal or a reference crank angle signal output by the crank angle sensor to a revolution number per unit time (engine revolution number).

The cooling water temperature sensor 203 outputs a signal according to a temperature of an engine cooling water. Instead of the temperature of the engine cooling water, a temperature of an engine lubricant oil may be employed.

The engine controller 101 stores map data in which various operation control parameters of the engine 1 such as a load of the engine 1, a fuel injection amount to the operation state such as the revolution speed, the cooling water temperature and the like are assigned, and during actual operation of the engine 1, the operation state of the engine 1 is detected, the fuel injection amount, the fuel injection timing, an ignition timing, a compression ratio and the like are set by referring to the map data on the basis of that, an instruction signal is output to driving circuits of the ignition plug 6 and the fuel injection valve 7, and an instruction signal is output to the actuator 39 of the variable compression ratio mechanism.

(Outline of Combustion Control)

In this embodiment, the engine 1 is operated with the excess air ratio λ, of the air-fuel mixture in the vicinity of 2. The "excess air ratio" is a value obtained by dividing the air-fuel ratio by a stoichiometric air-fuel ratio, and when the excess air ratio is "in the vicinity of 2", the excess air ratio of 2 and its vicinity are included, and in this embodiment, the excess air ratio within a range from 28 to 32 in the air-fuel ratio conversion or preferably the excess air ratio which is 30 in the air-fuel ratio conversion is employed. The "excess air ratio of the air-fuel mixture" refers to the excess air ratio in the entire cylinder and more specifically refers to a value obtained by dividing an actually supplied air amount by a minimum air amount on the basis of the minimum air amount (mass) theoretically required for combustion of the fuel supplied per combustion cycle to the engine 1.

Figure 3:
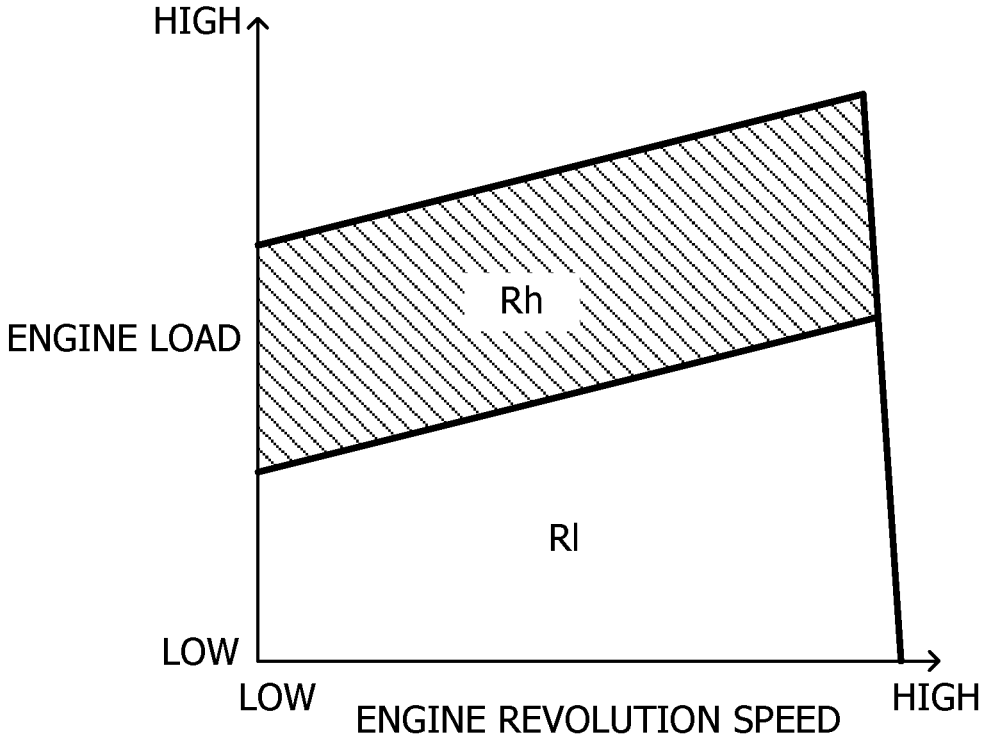
FIG. 3 is an explanatory view illustrating an example of an operation region map of the engine.

FIG. 3 illustrates an operation region map of the engine 1 according to this embodiment.

In this embodiment, the excess air ratio λ of the air-fuel mixture is set to the vicinity of 2 in the entire region where the engine 1 is actually operated regardless of the engine load. The region of the operation with the excess air ratio λ in the vicinity of 2 is not limited to the entire operation region of the engine 1 but may be a part of the operation region. For example, the excess air ratio λ can be set to the vicinity of 2 in a low load region and a middle load region in the entire operation region, and the excess air ratio λ may be switched in a high load region and set to the stoichiometric air-fuel ratio equivalent value (=1).

In the operation region where the excess air ratio λ is set to the vicinity of 2, in this embodiment, in a first region R1 where the engine load is at a predetermined value or less in the entire operation region of the engine 1, the excess air ratio λ is set to a first predetermined value λ1 in the vicinity of 2, and combustion is performed by forming a homogenous air-fuel mixture in which the fuel is diffused in the entire cylinder. On the other hand, in a second region Rh where the engine load is higher than the predetermined value, the excess air ratio λ is set to a second predetermined value λ2 in the vicinity of 2, a stratified air-fuel mixture in which the air-fuel mixture with rich fuel (first air-fuel mixture) is unevenly distributed in the vicinity of the ignition plug 6, and an air-fuel mixture with a fuel leaner than the first air-fuel mixture (second air-fuel mixture) is distributed in the periphery thereof is formed, and the combustion is performed.

In order to form the stratified air-fuel mixture, the fuel having the excess air ratio at the second predetermined value (λ=λ2) is injected in one combustion cycle in a plurality of number of times in this embodiment. A part of the fuel per combustion cycle is injected at a first timing during an intakestroke or a first half of a compression stroke, and at least a part of the remaining fuel is injected at a timing later than the first timing with respect to the crank angle, or more specifically, at a second timing immediately before the ignition timing of the ignition plug 6 in a second half of the compression stroke. In this embodiment, since the ignition timing is set during the compression stroke, the second timing is also a timing during the compression stroke.

Figure 4:
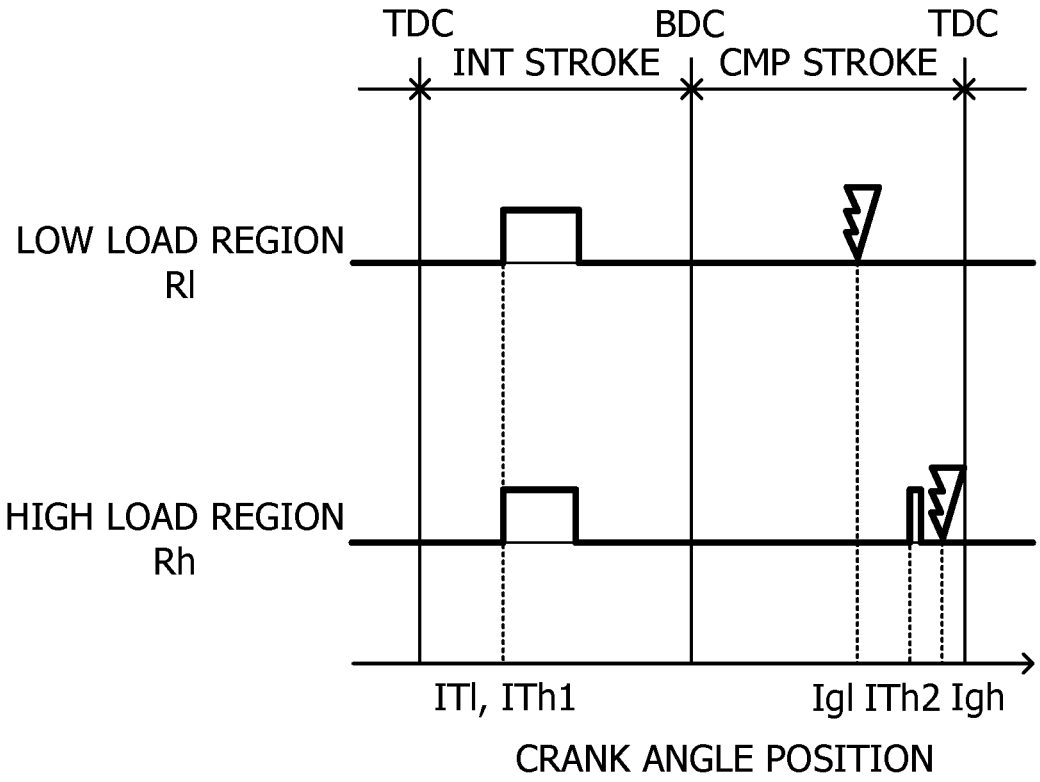
FIG. 4 is an explanatory view illustrating a fuel injection timing and an ignition timing corresponding to an operation region.

FIG. 4 illustrates a fuel injection timing IT and an ignition timing Ig according to the operation region.

In a first region R1 (low load region) where combustion is performed with homogenous air-fuel mixture, the fuel per combustion cycle is supplied in one injection operation performed during the intake stroke. The engine controller 101 sets a fuel injection timing IT1 during the intake stroke and outputs an injection pulse continuing over a period of time according to the fuel injection amount from the fuel injection timing IT1 to the fuel injection valve 7. The fuel injection valve 7 is opened/driven by the injection pulse and injects the fuel. In the first region R1, the ignition timing Ig1 is set during the compression stroke.

On the other hand, in the second region Rh (high load region) where the combustion is performed with the stratified air-fuel mixture, the fuel per combustion cycle is injected by being divided into twice, that is, during the intake stroke and the compression stroke. Approximately 90% of the entire fuel injection amount of the fuel is injected by a first injection operation, and the remaining 10% of the fuel is injected by the second injection operation. The engine controller 101 sets a first timing ITh1 during the intake stroke and a second timing ITh2 during the compression stroke as fuel injection timings and outputs the injection pulse continuing over the period of time according to the fuel injection amount in each time to the fuel injection valve 7. The fuel injection valve 7 is opened/driven by the injection pulse and injects the fuel in each of the first timing ITh1 and the second timing ITh2. The ignition timing Igh is set during the compression stroke in the second region Rh, too, but is set later than the ignition timing Ig1 in the first region R1.

The excess air ratio λ, (first predetermined value λ1) set in the first region R1 on the low load side and the excess air ratio λ (second predetermined value λ2) set in the second region Rh on the high load side can be set appropriately by considering heat efficiency of the engine 1, respectively. The first predetermined value λ1 and the second predetermined value λ2 may be values different from each other but may be equal values. In this embodiment, they are assumed to be equal values (λ1=λ2).

(Description of Fuel Spraying)

Figure 5:
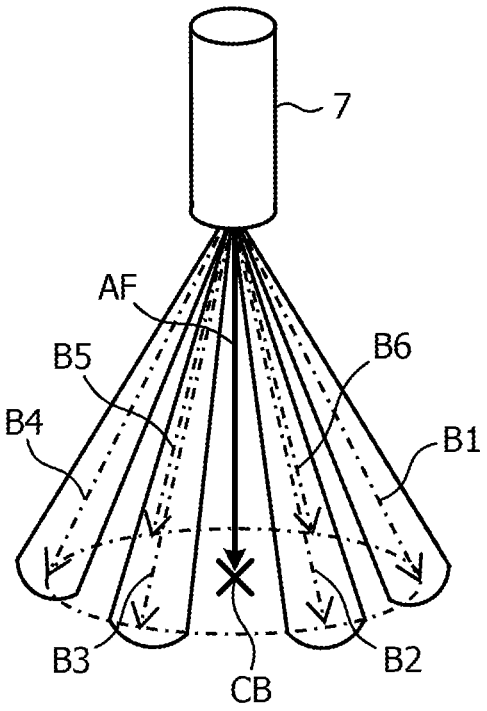
FIG. 5 is an explanatory view illustrating a spray beam gravity center line of a fuel injection valve.

FIG. 5 illustrates a spray beam gravity-center line AF of the fuel injection valve 7.

As described above, the fuel injection valve 7 is a multi-hole type fuel injection valve and in this embodiment, it has six injection holes. The spray beam gravity-center line AF is defined as a straight line connecting a distal end of the fuel injection valve 7 and a spray beam center CB, and an injection direction of the fuel injection valve 7 is specified as a direction along the spray beam gravity-center line AF. The "spray beam center" CB refers to a center of a virtual circle connecting distal ends of each of spray beams B1 to B6 at a time point when a certain period of time has elapsed since injection, assuming that the spray beams B1 to B6 are formed by the fuel injected by each of the injection holes.

Figure 6:
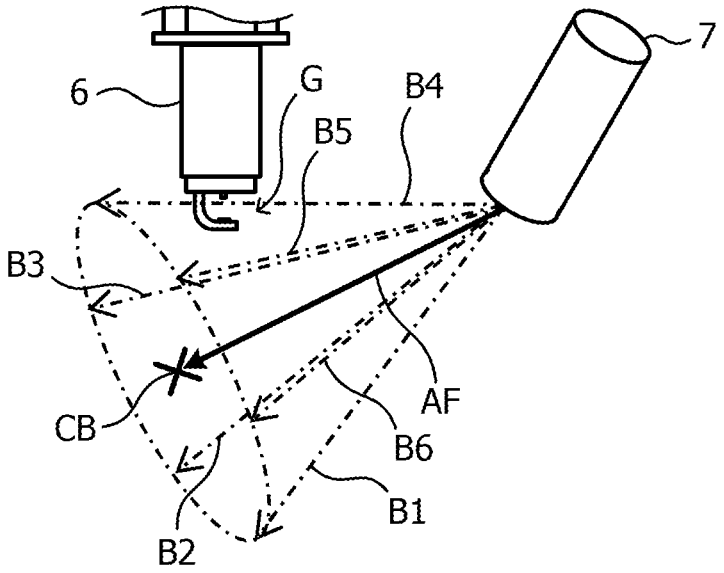
FIG. 6 is an explanatory view illustrating a position relationship between spraying and an ignition plug.

FIG. 6 illustrates a position relationship between the spray (spray beams B1 to B6) and the distal end of the ignition plug 6 (plug gap G).

In this embodiment, the spray beam gravity-center line AF is tilted to a center axis of the fuel injection valve 7, and an angle formed by the cylinder center axis Ax and the spray beam gravity-center line AF is enlarged to be larger than the angle formed by the cylinder center axis Ax and the center axis of the fuel injection valve 7. As a result, the spray can be brought close to the ignition plug 6 and directed so that the spray beam (the spray beam B4, for example) can pass in the vicinity of the plug gap G.

As described above, by causing the spray beam to pass in the vicinity of the plug gap G, fluidity can be generated by kinetic energy of the fuel spray injected immediately before the ignition timing Igh in the air-fuel mixture in the vicinity of the ignition plug 6, a plug discharge channel by ignition can be sufficiently extended even after the tumble flow is damped or collapsed, and ignitability can be ensured. The "plug discharge channel" refers to an ark generated in the plug gap G at ignition.

(Description Using Flowchart)

Figure 7:
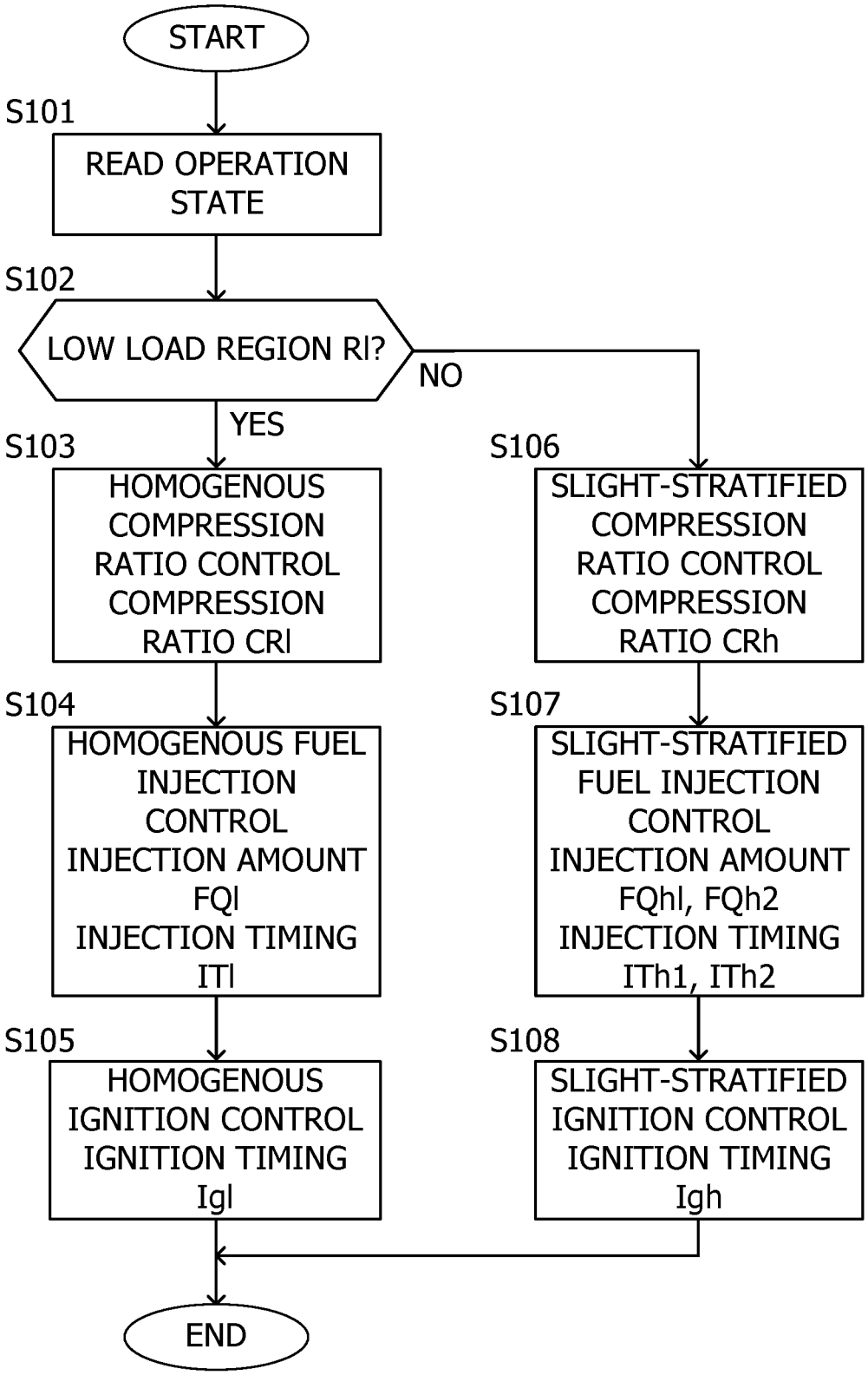
FIG. 7 is a flowchart illustrating a general flow of combustion control according to the embodiment of the present invention.

FIG. 7 illustrates an entire flow of the combustion control according to this embodiment by a flowchart.

Figure 8:
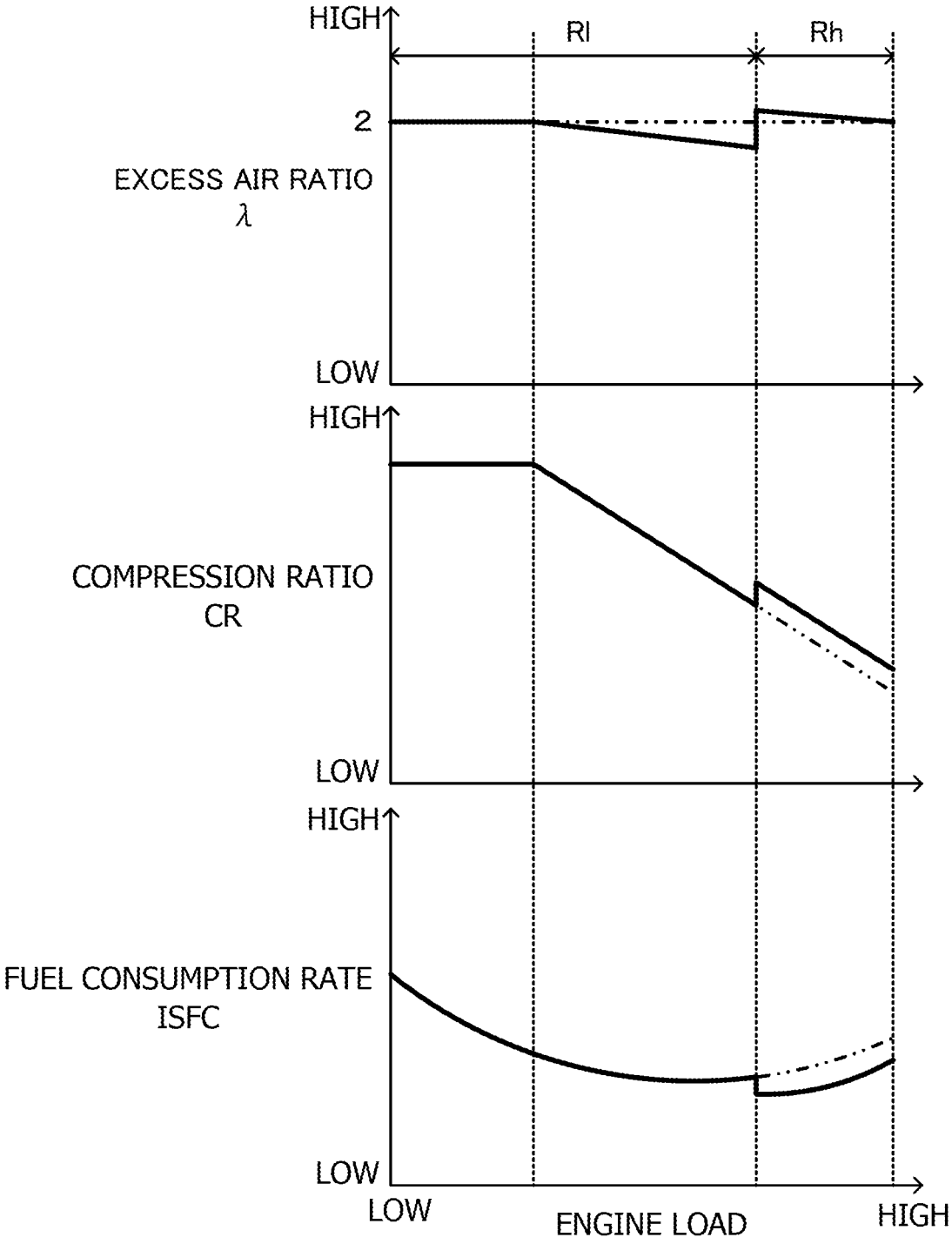
FIG. 8 is an explanatory view illustrating an example of changes in an excess air ratio, a compression ratio and a fuel consumption rate to an engine load.

FIG. 8 illustrates a change in the excess air ratio λ, a compression ratio CR and a fuel consumption rate ISFC to the engine load.

The combustion control according to this embodiment will be described by using FIG. 7 while referring to FIG. 8 as appropriate. The engine controller 101 is programmed to execute a control routine illustrated in FIG. 7 at each predetermined time.

In this embodiment, in addition to switching between the homogenous air-fuel mixture and the stratified air-fuel mixture described above, compression ratios CR1 and CRh of the engine 1 are changed in accordance with the operation regions R1 and Rh by the variable compression ratio mechanism.

At S101, an accelerator position (accelerator opening degree) APO, an engine revolution speed Ne, a cooling water temperature Tw and the like are read as the operation state of the engine 1. The operation state such as the accelerator position APO is calculated by an operation state calculation routine executed separately on the basis of the detection signals of the accelerator sensor 201, the revolution speed sensor 202, the cooling water temperature sensor 203 and the like.

At S102, it is determined whether the operation region of the engine 1 is the first region R1 on the low load side or not on the basis of the read operation state. Specifically, if the accelerator position APO is at a predetermined value or less determined for each engine revolution speed Ne, it is determined that the operation region is the first region R1, processing proceeds to S103, and the engine 1 is operated by homogenous combustion in accordance with a procedure at S103 to 105. On the other hand, if the accelerator position APO is higher than the predetermined value for the aforementioned each engine revolution speed Ne, it is determined that the operation region is the second region Rh on the high load side, processing proceeds to S106, and the engine 1 is operated by slight stratified combustion in accordance with the procedure at S106 to 108.

At S103, the compression ratio CR1 for the first region R1 is set. In the first region R1, the compression ratio CR1 is set to as a large value as possible within a range where knocking does not occur. In this embodiment, as illustrated in FIG. 8, a target compression ratio having a tendency to lower with respect to an increase in the engine load is set in advance, and the higher the engine load is, the more the compression ratio CR1 is lowered by controlling the variable compression ratio mechanism on the basis of the target compression ratio. However, this is not limiting, and it may be so configured that a knock sensor is installed in the engine 1, and the variable compression ratio mechanism is made to lower the compression ratio CR1 when occurrence of knocking is detected under the target compression ratio set as a constant value so that the knocking is suppressed.

At S104, the fuel injection amount FQ1 and the fuel injection timing IT1 for the first region R1 are set. Specifically, the fuel injection amount FQ1 is set on the basis of the load, the revolution speed and the like of the engine 1, and the fuel injection timing IT1 is set. The setting of the fuel injection amount FQ1 and the like are as follows, for example.

A basic fuel injection amount FQbase is calculated on the basis of the accelerator position APO and the engine revolution speed Ne, and the fuel injection amount FQ per combustion cycle is calculated by applying correction according to the cooling water temperature Tw or the like to the basic fuel injection amount FQbase. And the calculated fuel injection amount FQ (=FQ1) is substituted in the following equation so as to convert it to an injection period or an injection pulse width Δt and moreover, the fuel injection timing IT1 is calculated. The calculation of the basic fuel injection amount FQbase and the fuel injection timing IT1 can be made by searching from a map determined in advance by adaptation through experiments and the like.

$$FQ=\rho*A*Cd*\sqrt{\{(Pf-Pa)/\rho\}}*\Delta t \quad (1)$$

In the aforementioned equation (1), it is assumed that the fuel injection amount is FQ, a fuel density is ρ, an injection nozzle total area is A, a nozzle flowrate coefficient is Cd, a fuel injection pressure or a fuel pressure is Pf, and an in-cylinder pressure is Pa.

At S105, the ignition timing Ig1 for the first region R1 is set. In the first region R1, the ignition timing Ig1 during the compression stroke is set. Specifically, the ignition timing Ig1 is set to MBT (minimum advance for best torque) or timing in the vicinity thereof.

At S106, the compression ratio CRh for the second region Rh is set. In the second region Rh, the compression ratio CRh is set to the compression ratio lower than the first region R1. Then, similarly to that in the first region R1, a target compression ratio having a tendency to lower with respect to the increase in the engine load is set in advance, and the compression ratio CRh is lowered by controlling the variable compression ratio mechanism on the basis of the target compression ratio, but if a knock sensor is provided, it may be so configured that the variable compression ratio mechanism is made to lower the compression ratio CRh when occurrence of knocking is detected under the target compression ratio set as a constant value (lower than the value set in the first region R1) so that the knocking is suppressed.

Here, in this embodiment, the compression ratio CRh for the second region Rh is set to a compression ratio higher than a compression ratio by which the knocking can be suppressed when the combustion is performed by the homogenous air-fuel mixture under the same operation state (engine load). FIG. 8 indicates a compression ratio by which the knocking can be suppressed in the case by the homogenous air-fuel mixture by a two-dot chain line. As described above, in this embodiment, the compression ratio CRh for the second region Rh is a compression ratio higher than the compression ratio in the case of the homogenous air-fuel mixture indicated by the two-dot chain line by the constant value. With regard to the second region Rh, to "set the compression ratio CRh to the compression ratio lower than the first region R1" refers to that "lower than the first region R1" as a general tendency throughout the entire engine load.

Moreover, FIG. 8 illustrates a change in the excess air ratio λ. In this embodiment, the excess air ratio λ decreases from λ=2 in the first region R1 with respect to the increase in the engine load and increases to a value slightly larger than 2 at a time of shifting from the first region R1 to the second region Rh and then, decreases toward λ=2 in the second region Rh. Such a behavior of the excess air ratio λ indicated to the increase in the engine load is not an active design intention to change the excess air ratio λ itself. The decrease of the excess air ratio λ in the first region R1 is caused by adjustment for securing ignitability to the lowering of the compression ratio CR1 for the purpose of suppression of knocking or in other words, by increasing correction of the fuel within a range not damaging an effect by leaning of the air-fuel mixture. And the increase in the excess air ratio λ at the time of shifting from the first region R1 to the second region Rh is adjustment that ignitability is improved by stratification of the air-fuel mixture, whereby combustion under the higher excess air ratio λ is made possible.

At S107, the fuel injection amounts FQh1 and FQh2 and the fuel injection timings ITh1 and ITh2 for the second region Rh are set. Specifically, similarly to the first region R1, the basic fuel injection amount FQbase according to the operation state of the engine 1 is calculated, and by applying correction according to the cooling water temperature Tw and the like to the basic fuel injection amount FQbase, the fuel injection amount FQ per combustion cycle is calculated. Then, a predetermined ratio (90%, for example) in the calculated fuel injection amount FQ is set to the fuel injection amount FQh1 during the intake stroke, and the remaining to the fuel injection amount FQh2 during the compression stroke. Moreover, the fuel injection amounts FQh1 and FQh2 are substituted in the aforementioned equation (1), respectively, and converted to the injection periods or the injection pulse widths Δt1 and Δt2, and the fuel injection timing ITh1 during the intake stroke and the fuel injection timing ITh2 during the compression stroke are calculated. Distribution of the fuel injection amounts FQh1 and FQh2 and the calculation of the fuel injection timings ITh1 and ITh2 can be also made by searching from a map determined in advance by adaptation through experiments and the like similarly to the basic fuel injection amount FQbase.

At S108, the ignition timing Igh for the second region Rh is set. In the second region Rh, the ignition timing Igh and an interval from the fuel injection timing ITh2 to the ignition timing Igh are set so that combustion is generated in the entire cylinder by using the fuel injected in the fuel injection timing ITh2 as a source, and a peak in heat generation can come at timing slightly after a compression top dead center point. Specifically, the ignition timing Igh is set at the timing during the compression stroke later than the ignition timing Ig1 in the first region R1 or immediately before the compression top dead center point as illustrated in FIG. 4 in this embodiment.

In this embodiment, the "controller" is configured by the engine controller 101, and the "control device for direct fuel injection engine" is configured by the ignition plug 6, the fuel injection valve 7, and the engine controller 101. In the flowchart illustrated in FIG. 7, a function of an "operation state detection unit" is realized by processing at S101, a function of a "fuel injection control unit" is realized by processing at S104 and S107, and a function of an "ignition control unit" is realized by processing at S105 and S108.

Contents of the fuel control according to this embodiment have been described above, and effects obtained by this embodiment will be summarized below.

(Description of Working Effects)

First, in this embodiment, by setting the excess air ratio λ, of the air-fuel mixture to the vicinity of 2, combustion with high heat efficiency is realized, and fuel costs can be reduced. And in the first region R1 on the low load side of the operation region of the engine 1, the homogenous air-fuel mixture having the excess air ratio λ in the vicinity of 2 is formed to perform combustion, while in the second region Rh on the high load side of the operation region of the engine 1, the combustion form is switched, and the stratified air-fuel mixture having the excess air ratio λ in the vicinity of 2 is formed to perform combustion so that a combustion speed (flame propagation speed) increases more than that of the combustion with the homogenous air-fuel mixture, and knocking resistance of the combustion is improved and thus, knocking can be suppressed without relying on retarding of the ignition timing. That is, according to this embodiment, high heat efficiency can be realized over the entire operation region through improvement of the heat efficiency particularly in the high load region. Moreover, by setting excess air ratio λ to a value from 28 to 32 or particularly approximately 30 in the air-fuel ratio conversion, an air-fuel mixture suitable for improvement of the heat efficiency can be formed.

Secondly, in the second region Rh on the high load side, a part of the fuel to be supplied per combustion cycle is injected to the engine 1 in the intake stroke, and at least a part of the remaining fuel is injected immediately before the ignition timing Igh of the ignition plug 6 so that favorable ignitability can be maintained by using the fuel unevenly distributed in the vicinity of the ignition plug 6 or the second air-fuel mixture as a source, and stable combustion can be realized even with the lean air-fuel mixture. Here, a flow is generated in the air-fuel mixture in the vicinity of the ignition plug 6 by kinetic energy of the fuel spray injected immediately before the ignition timing Igh, and by performing ignition while the disturbance remains, a plug discharge channel is extended, formation of initial flame is aided, and more stable combustion is realized.

Thirdly, the ignition plug 6 is installed between the intake port 4*a* and the exhaust port 5*a*, and the fuel injection valve 7 is installed at a position surrounded by the ignition plug 6 and the intake ports 4*a* and 4*a*, in other words, the fuel injection valve 7 is disposed closer to the ignition plug 6 than the intake port 4*a* so that the second air-fuel mixture can be favorably formed.

Fourthly, the compression ratio CR of the engine 1 is made changeable, and the compression ratio CR (=CRh) in the second region Rh on the high load side is made lower than that in the first region R1 on the low load side so that knocking can be suppressed more reliably.

Here, if the compression ratio CR is made lower, not only that the heat efficiency is lowered but also ignitability is deteriorated by lowering of the in-cylinder temperature, and combustion is made unstable. On the other hand, the ignitability can be ensured by lowering the excess air ratio λ, of the air-fuel mixture and by relatively increasing the fuel amount in the air-fuel mixture. However, in this case, not only that the effect of improvement of fuel efficiency by leaning of the air-fuel mixture is lessened but also that there is a concern that the NOx emission is increased.

In this embodiment, since the anti-knocking performance of the combustion is improved by performing the combustion by forming the stratified air-fuel mixture in the second region Rh, the knocking can be suppressed with a compression ratio higher than that by the homogenous air-fuel mixture, and the fuel consumption rate can be reduced. FIG. 8 illustrates that the fuel consumption rate ISFC can be reduced as compared with the case using the homogenous air-fuel mixture (the fuel consumption rate of the case using the homogenous air-fuel mixture is indicated by a two-dot chain line) by performing combustion with the stratified air-fuel mixture. And since ignitability can be ensured by stratifying the air-fuel mixture without lowering the excess air ratio λ, high heat efficiency can be maintained.

Figure 9:
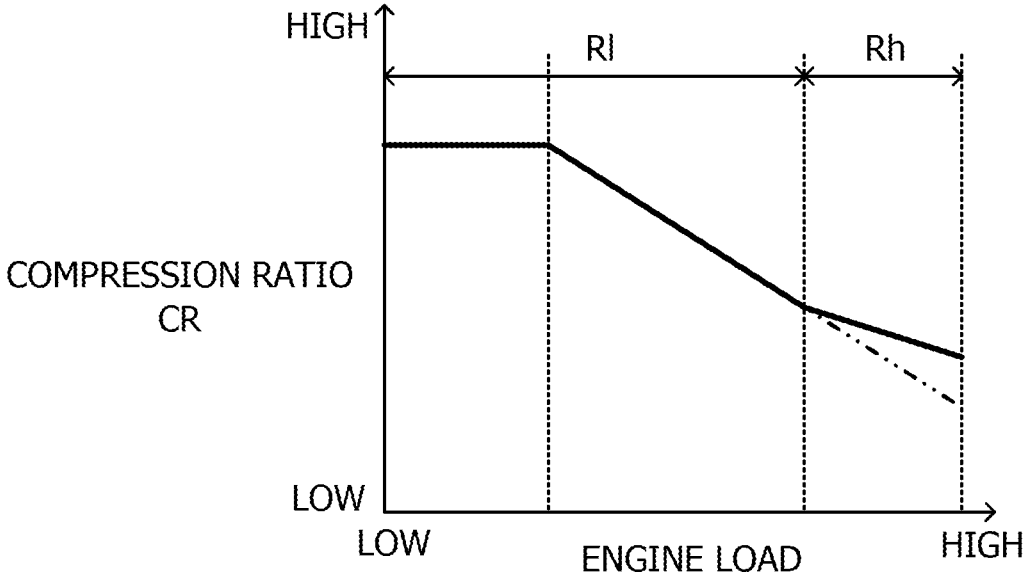
FIG. 9 is an explanatory view illustrating a change example of the change in the compression ratio to the engine load.

In this embodiment, as illustrated in FIG. 8, the compression ratio CR is increased in steps at the time of shifting from the first region R1 to the second region Rh with respect to the increase in the engine load (however, in actual driving, there is a delay according to characteristics of the actuator 39 and the link mechanisms 31, 32, 33 and the like in an operation of the variable compression ratio mechanism). The compression ratio CRh for the second region Rh is not limited to such setting but may be continuously changed with respect to the increase in the engine load. Though depending on the operation delay of the variable compression ratio mechanism, in the second region Rh, the compression ratio CRh is changed so that a difference from the compression ratio capable of suppressing knocking (indicated by the two-dot chain line) in the case of the homogenous air-fuel mixture is increased with respect to the increase in the engine load as illustrated in FIG. 9, for example.

The embodiment of the present invention has been described, but the embodiment only illustrates a part of the application example of the present invention and is not intended to limit the technical range of the present invention to the specific configuration of the aforementioned embodiment. Various changes and modifications of the aforementioned embodiment are possible within a range of the matters described in claims.

The invention claimed is:

1. A control method of a direct fuel injection engine including an ignition plug and a fuel injection valve arranged to be capable of injecting a fuel directly in a cylinder, the engine having an operation region in which an excess air ratio of an air-fuel mixture is set in a vicinity of 2 and being configured to perform, in the operation region, spark ignition combustion with the ignition plug, wherein in a first region on a low load side of the operation region, a homogenous air-fuel mixture having the excess air ratio at a first predetermined value in the vicinity of 2 is formed to perform the spark ignition combustion; and in a second region on a load side higher than the first region of the operation region, a stratified air-fuel mixture having the excess air ratio at a second predetermined value in the vicinity of 2 is formed to perform the spark ignition combustion.

2. The control method of a direct fuel injection engine according to claim 1, wherein the first predetermined value is equal to the second predetermined value.

3. The control method of a direct fuel injection engine according to claim 2, wherein the first predetermined value and the second predetermined value are 28 to 32 in air-fuel ratio conversion.

4. The control method of a direct fuel injection engine according to claim 1, wherein in the second region, to form the stratified air-fuel mixture, a part of the fuel that gives the excess air ratio of the air-fuel mixture at the second predetermined value is injected at a first timing, and at least a part of a remaining fuel is injected at a second timing later than the first timing, so that a first air-fuel mixture with rich fuel is unevenly distributed in a vicinity of the ignition plug, and a second air-fuel mixture leaner than the first air-fuel mixture is dispersed around the first air-fuel mixture.

5. The control method of a direct fuel injection engine according to claim 4, wherein the first timing is set at a timing during an intake stroke or a first half of a compression stroke, and the second timing is set at a timing immediately before an ignition timing of the ignition plug.

6. The control method of a direct fuel injection engine according to claim 1, wherein the ignition plug is disposed between an intake port and an exhaust port;

the fuel injection valve is disposed between the intake port and the ignition plug; and an injection direction of the fuel injection valve is set so that at least a part of fuel spray passes in a vicinity of a plug gap of the ignition plug.

7. The control method of a direct fuel injection engine according to claim 1, wherein the engine is configured to be capable of changing a compression ratio thereof; and the compression ratio is set lower in the second region than in the first region.

8. The control method of a direct fuel injection engine according to claim 1, wherein in the second region, a compression ratio is set higher than a compression ratio at which knocking of the engine is suppressed under a situation that a homogenous air-fuel mixture is formed to perform combustion under the same operation state.

9. A control device for a direct fuel injection engine comprising:

an ignition plug;

a fuel injection valve arranged to be capable of injecting a fuel directly in a cylinder; and a controller configured to control operation of the ignition plug and the fuel injection valve, the engine having an operation region in which an excess air ratio of an air-fuel mixture is set in a vicinity of 2 and being configured to perform, in the operation region, spark ignition combustion with the ignition plug, wherein the controller is configured to:

detect an operation state of the engine;

set an injection amount and an injection timing of the fuel injection valve on the basis of the operation state of the engine; and set an ignition timing of the ignition plug; and the controller sets:

when the engine operation state is in a first region of the operation region, the injection amount and the injection timing to form a homogenous air-fuel mixture having the excess air ratio of the air-fuel mixture at a first predetermined value in the vicinity of 2; and when the engine operation state is in a second region of the operation region on a load side higher than the first region, the injection amount and the injection timing to form a stratified air-fuel mixture having the excess air ratio of the air-fuel mixture at a second predetermined value in the vicinity of 2.

* * * * *